US007523572B2

(12) United States Patent
Pasqualini

(10) Patent No.: US 7,523,572 B2
(45) Date of Patent: Apr. 28, 2009

(54) ASSEMBLY FOR COUPLING WEAR PARTS TO SUPPORT TOOLS FOR HEAVY-CONSTRUCTION MACHINERY

(75) Inventor: Charles Pasqualini, Feurs (FR)

(73) Assignees: Predac, Feurs (FR); AFE Metal, Feurs (FR)

( * ) Notice: Subject to any disclaimer, the term of this patent is extended or adjusted under 35 U.S.C. 154(b) by 22 days.

(21) Appl. No.: 11/720,344

(22) PCT Filed: Dec. 1, 2005

(86) PCT No.: PCT/FR2005/051017

§ 371 (c)(1),
(2), (4) Date: Aug. 8, 2007

(87) PCT Pub. No.: WO2006/059043

PCT Pub. Date: Jun. 8, 2006

(65) Prior Publication Data

US 2008/0201996 A1 Aug. 28, 2008

(30) Foreign Application Priority Data

Dec. 2, 2004 (FR) ..... 04 52840
Mar. 22, 2005 (FR) ..... 05 50734

(51) Int. Cl.
*E02F 9/28* (2006.01)

(52) U.S. Cl. ..... 37/456

(58) Field of Classification Search ..... 37/446, 37/452, 453, 454, 455, 456, 457, 458–460
See application file for complete search history.

(56) References Cited

U.S. PATENT DOCUMENTS 2,934,842 A 5/1960 Buskirk
6,079,132 A 6/2000 Clendenning et al.
6,247,255 B1 6/2001 Clendenning
6,477,796 B1 * 11/2002 Cornelius ..... 37/452

* cited by examiner

*Primary Examiner*—Robert E Pezzuto
(74) *Attorney, Agent, or Firm*—Heslin Rothenberg Farley & Mesiti P.C.

(57) ABSTRACT

An assembly for coupling wear parts to support tools for heavy-construction machinery includes a tooth and an adapter with a key connection. The tooth and the adapter have complementary support profiles located in different planes and disposed between respective contact and connection ends. The profiles are arranged in a symmetrically opposing manner on upper and lower faces of a nose of the adapter and the tooth.

8 Claims, 13 Drawing Sheets

SECTION AA

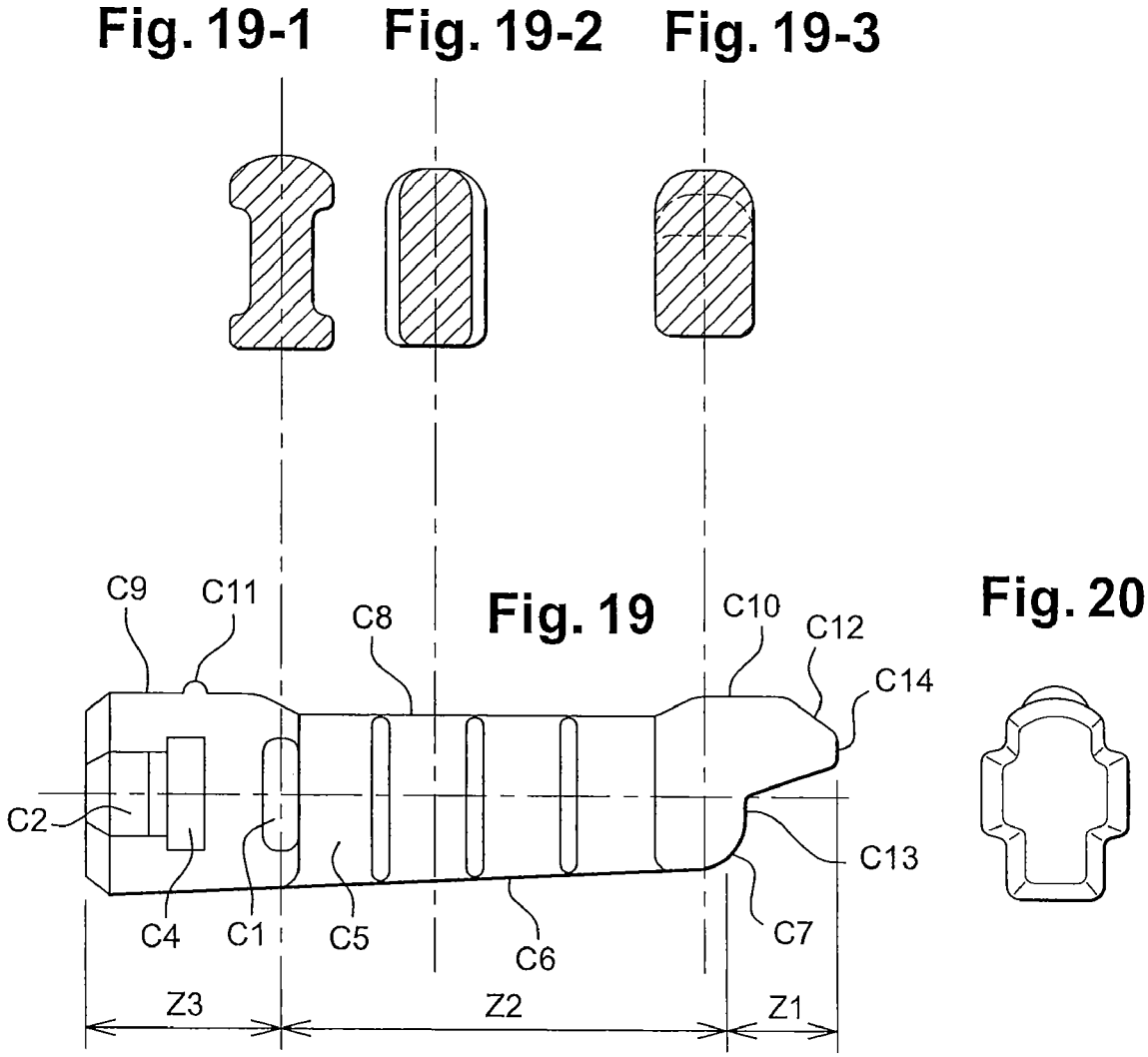
Fig. 19-1
Fig. 19-2
Fig. 19-3
C9
C11
C8
C10
C12
C14
C2
C13
C4
C1
C5
C6
C7
Z3
Z2
Z1
Fig. 19
Fig. 20
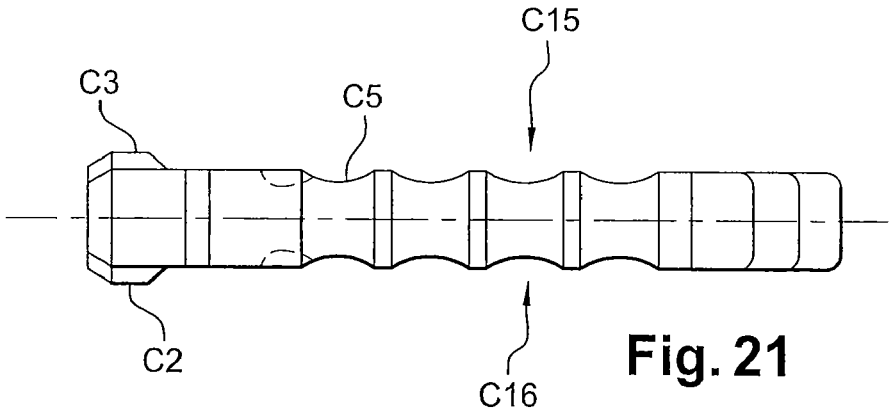
C15
C3
C5
C2
C16
Fig. 21

$a_1$ $F_{1.3}$ $F_1$
IV $F_{1.1}$
$F_{1.2}$
$F_{1.4}$
$F_2$
$F_3$
IV $F_{1.5}$
$F_{1.6}$

ASSEMBLY FOR COUPLING WEAR PARTS TO SUPPORT TOOLS FOR HEAVY-CONSTRUCTION MACHINERY

CROSS REFERENCE TO RELATED APPLICATIONS

This application is a Section 371 filing of International Application No. PCT/FR2005/051017 filed on Dec. 1, 2005, and published, in French, as International Publication WO 2006/059043 A1 on Jun. 8, 2006, and claims priority of French Patent Application No. 0452840 filed on Dec. 2, 2004 and French Patent Application No. 0550734 filed on Mar. 22, 2005, all of which applications are hereby incorporated herein, in their entirety.

BACKGROUND ART

The invention relates to the technical field of civil engineering machines presenting skips, buckets or other receptacles capable of scraping, removing, shifting materials or other items for their removal from a given place to other operating stations using civil engineering machines.

The prior art discloses how to place, on the abovementioned skips, buckets, receptacles and similar items, appropriate adapter noses which are capable of receiving removable teeth having a matching profile. These teeth are in direct contact with the materials, items to be removed, to scrape, and are consequently subject to rapid wear due to their severe use. The adapter noses formed on the skips, buckets and other receptacles are male parts integral with the lip of the preformed skip, bucket or receptacle, and are made added on or one-piece during the conformation of the bucket, skip or receptacle, or other particular tools. The teeth which are added on constitute female parts established in shapes matching the profiles of the adapter nose(s) to engage therein. The need to replace the teeth, to contend for their wear, requires a connection between the wear parts and the corresponding adapter nose. In the prior art, this connection is proposed by numerous manufacturers in the form of a keying which may be either direct metallic, or assisted by an elastic material.

Experience shows that, irrespective of the nesting and connecting systems employed, it is impossible, because of the manufacturing tolerances which impose clearances to permit the assembly of the teeth on their adapter support, added to those which are formed by the ramming and the service wear of the contact zones, to prevent any possible movement of the tooth on its adapter support.

Thus, the teeth are connected to their adapter noses by keying to permit their removal and replacement after the teeth are worn. The horizontal, lateral, oblique or miscellaneous loads inherent in the applications and uses also cause damage to the tooth-nose-adapter connection, but also to the keying. The tooth is observed to pivot with respect to the adapter nose, causing damage thereto by wear due to friction.

These two major problems are observed to combine or not, depending on the arrangements of the teeth and adapters.

On the first problem and in the prior art, the tooth-adapter nesting configuration is often found, as shown in FIG. 1, in the form of a pyramidal or frustoconical nesting.

During the application of the crowding force (FC), shown in FIG. 2, which is the highest stress received during the loading of skips and buckets, there is a tilting movement in the direction indicated by (R). The tooth tends to tilt on its adapter support and the lower wall of the cavity (Ci) bears very strongly on the lower body of the adapter support.

As long as the clearances between tooth and adapter are low, the allowable tilt of the tooth is also low and the force on the contact zone (Ci) is acceptable for the strength of the tooth case.

A moment arrives when the clearance (J) between the tooth and its adapter support is such that it may exert a wedge action in the tooth case, which then cracks, tears or bursts (FIG. 2), making the tooth inoperative.

The strongest configuration is also known, according to FIG. 3. The nose of the adapter support, in its front part, has a stabilisation flat, and the back of the adapter support comprises housings receiving the two lugs of the tooth. The clearance established in the production of the parts is such that J2 between the upper and lower sides of the socket is higher than that produced at the stabilisation flat and the lugs (J1). J2>J1.

During the application of the crowding force (FC) to this configuration also shown in FIG. 4, the tooth bears on the stabilisation flat to which a force (FPS) is applied, initiating a rotation along (R), blocked by the contact of the tooth lugs which transmit the force (FO) to their housings of the adapter support. Accordingly, the bearing force at (Ci) is reduced and the risk of bursting the tooth case is lower than in the previous case (FIGS. 1 and 2).

However, experience shows that in use, the stabilisation flats and the tooth lug housings become worn by the ramming and the friction, and the clearance which then exists with the corresponding faces of the new replacement teeth increases considerably. The advantage of absorbing the loads, by the support of the tooth lugs in their housings in the adapter support, no longer exists, producing the previous case shown in FIGS. 1 and 2.

If we now return to the second problem, the problem of keying, the following may be observed.

According to known practice, teeth keying systems, to guarantee their tension on their adapter supports, are placed either vertically or horizontally. Their keys may or may not be assisted by an elastic element. Placed horizontally, they have the drawback of difficult access due to the too close presence of the neighbouring adapters. Placed vertically, they are liable to lose keys, particularly via the bottom.

The elastic elements of the abovementioned type are sometimes made in the form of tubular sleeves and two systems are known:

The first concerns a vertical key formed by two cylinders screwed to one another, one forming a bolt and the other a nut (FIGS. 5, 6 and 7). A rubber tube is placed between the two. By screwing the two elements forming the key closer together, the rubber tube tends to be crushed and expanded. It is positioned in a recess provided in the adapter body where it can expand, and stiffen under the screwing pressure. This ensures the retention of the key in service. On the other hand, the rubber, whereof the position is imposed by the recess in the adapter, places the metal elements forming the key in a random position with respect to the orifices of the tooth, where they cannot systematically be found in a back contact position to guarantee retention of the tooth. In addition, in practice, in the case of a favourable random position of the key, there is little or no rear bearing force for retaining the tooth.

The second is placed horizontally (FIGS. 8 and 9). A rubber tube is introduced into its housing in the adapter. After installing the tooth, a cylindrical rod forming a key is introduced via one or the other of the orifices of the tooth. The rod diameter is slightly higher than the inside diameter of the rubber tube to generate tightness in order to ensure the retention of the key during service.

This device, which has the drawbacks of the previous one, concerning the random position of the key with respect to the orifices of the tooth and the lack of retaining force, is only employed in special cases where there is no tooth extraction force. It is only employed in so-called RIPPER applications in which the teeth are only loaded in the forward direction. The penetration work direction, on the contrary, tends to press the tooth strongly against its adapter support.

The principle of sandwich keys is also known, as described by the Applicant, placed particularly with a particular structure of two mutually displaceable components and between which an elastically deformable material is placed. Such a key is described in patent PCT WO 2004/035945 to the Applicant. This type of key is however specific to a configuration of the tooth with a skirt surrounding and protecting the adapter.

The Applicant also uses a particular method called "STICKEY method", the subject matter of patent EP No. 618.334, which provides for the insertion of a key in a vertical plane, the key being tapered from the top downwards, and receiving the assembly material in an appropriate chamber. The latter is in the form of a resin which solidifies to form a retaining sleeve between the tooth and the adapter.

In all the known cases of the Applicant described above, the key is fully embedded in the connecting volume between the tooth and the adapter. Specific tools are therefore needed to remove it and/or extract it, or even to heat the elastic material to make it liquid so as to permit the removal of the key.

BRIEF SUMMARY OF THE INVENTION

Faced with all these problems, the Applicant's approach has therefore been to reflect on a novel design of the tooth-adapter coupling which is easy to implement and which perfectly meets the various requirements.

This reflection was first focused on an arrangement of the tooth and the adapter nose to absorb all the loads by reducing the wear processes by a better absorption of the loads.

This reflection also focused on the tooth-adapter connection by the design of a specific keying device in response to the problems posed and the final objectives.

Thus the Applicant's approach has been to propose a tooth-adapter coupling assembly making it possible, independently or in combination, according to the cases and applications, to implement the particular arrangements in the contact zones between the tooth and the adapter nose, on the one hand, and in the introduction of a keying device on the other. Thus the connection between the tooth and the adapter is improved substantially by the addition of complementary contact zones in order to absorb the loads of all types and multidirectional loads.

The new design of the keying device also participates in limiting the movement between the tooth and the adapter, while eliminating, as far as it is concerned, any risk of escape upwards or downwards, in the nose-adapter connection, which is perfectly secure and leaves no possibility of accidental hooking during in situ utilisation.

According to a first feature of the invention, the assembly for coupling wear parts on tool holders for civil engineering machines of the type comprising a tooth and an adapter with a key connection is characterised in that the tooth and the adapter are arranged with bearing profile matching forms, in different planes, located between their respective contact and connecting ends, the said shapes being arranged symmetrically and opposably on the upper and lower faces of the nose of the adapter and of the tooth.

According to another feature, the assembly for coupling wear parts on tool holders for civil engineering machines of the type comprising a key for assembling a tooth with an adapter, the key being positioned vertically, the said key fitting into a plastic receiving sleeve, the tooth and the adapter being arranged with openings and support and stop zones allowing the insertion of the key-sleeve assembly and its maintenance, is characterised in that the key is arranged with three specific zones, one intermediate zone for engaging and cooperating with the sleeve, another upper zone projecting from the sleeve and being arranged with means for gripping and positioning a dismantling tool, and another lower zone for engaging in the low part forming the seat of the tooth, and in that the key in its intermediate part has on its sides a plurality of horizontal zones for gripping tools prolonged by an alternation of hollow and projecting zones suitable for cooperating with a plurality of matching projections and hollows established in the sleeve for adjustment and anchoring, and in that the tooth is arranged with an upper flared opening for introducing the key and for positioning and actuating a tool for the disengagement of the key.

According to another feature, the assembly for coupling wear parts on tool holders for civil engineering machines is characterised in that the tooth and the adapter are arranged with bearing profiled matching shapes located between their respective contact and connecting ends, the said shapes being arranged symmetrically and opposably on the upper and lower faces of the nose of the adapter and of the tooth, and in that the key is arranged with three specific zones, one intermediate zone for engaging and cooperating with the sleeve, another upper zone projecting from the sleeve and being arranged with means for gripping and positioning a dismantling tool, and another lower zone for engaging in the low part forming the seat of the tooth, and in that the key in its intermediate part has on its sides a plurality of horizontal zones for gripping tools prolonged by an alternation of hollow and projecting zones suitable for cooperating with a plurality of matching projections and hollows established in the sleeve for adjustment and anchoring, and in that the tooth is arranged with an upper flared opening for introducing the key and for positioning and actuating a tool for the disengagement of the key.

These features and others will clearly emerge from the rest of the description.

BRIEF DESCRIPTION OF THE DRAWING FIGS.

To establish the object of the invention illustrated in a non-limiting manner in the figures of the drawings where:

FIG. 19 is a side view of the key of the invention.

FIGS. 19.1, 19.2 and 19.3 are cross sectional views along I.I, II.II and III.III of FIG. 19, on the various successive sections of the key.

FIG. 20 is a plan view of the key according to FIG. 19.

FIG. 21 is a front view of the key according to FIG. 19.

Figures 22, 23, 24, 25, 26:
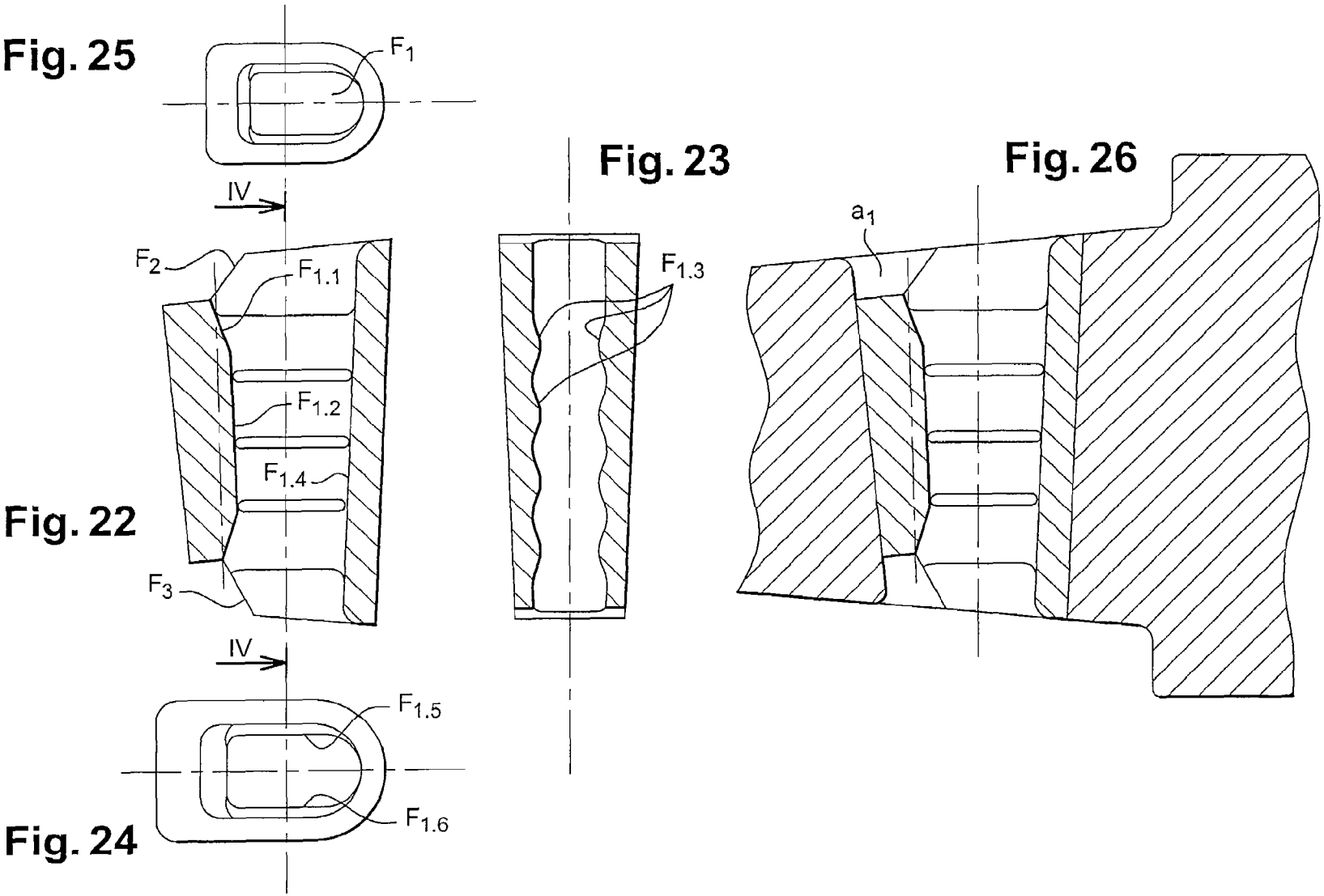

FIG. 22 is a side view and cross section of the key receiving sleeve of the invention.

FIG. 23 is a front view and cross section along line IV.IV of FIG. 22.

FIG. 24 is a plan view according to FIG. 22.

FIG. 25 is a bottom view according to FIG. 22.

FIG. 26 is a partial cross section of the adapter receiving the said sleeve.

Figure 27:
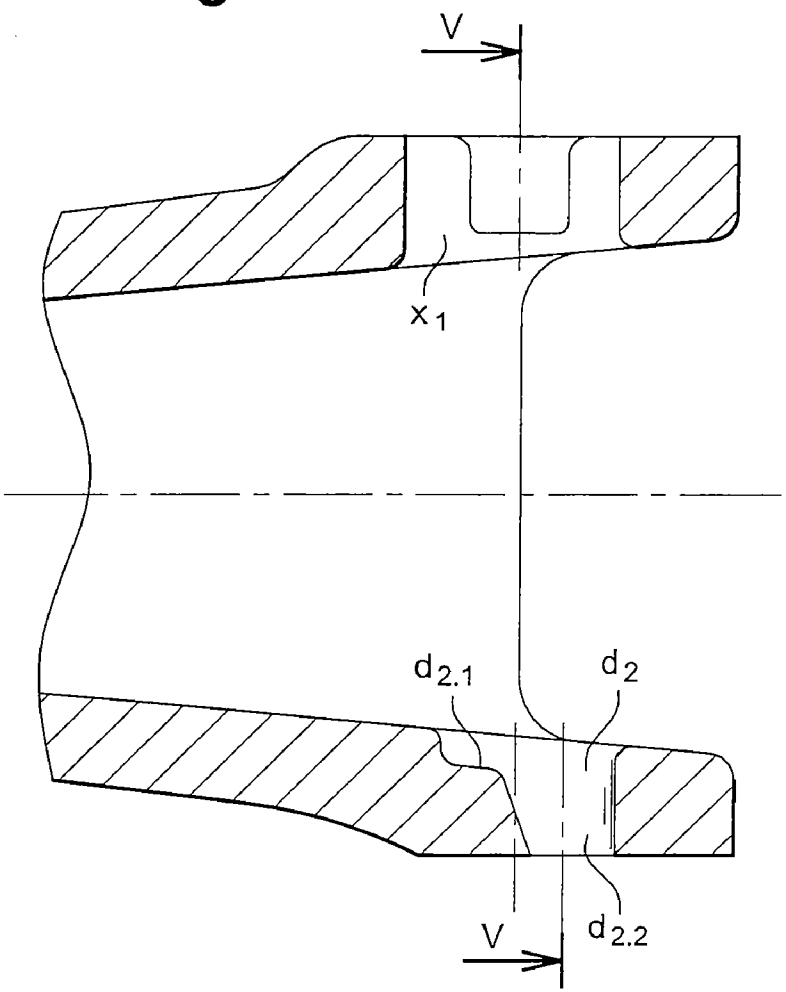

FIG. 27 is a partial view and cross section of the tooth fitting on the adapter and receiving the key of the invention.

Figure 28:
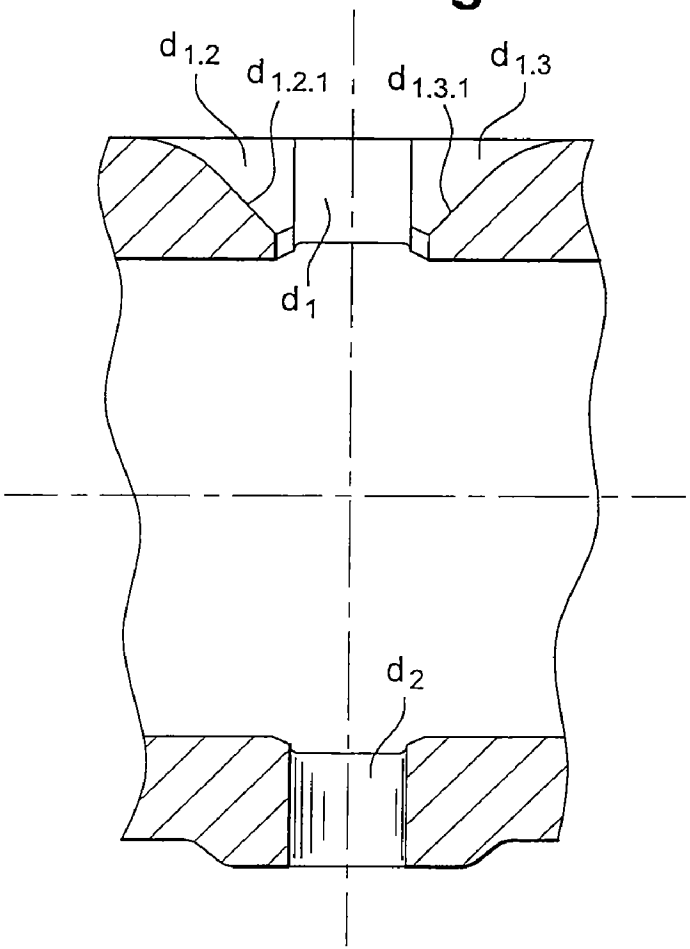

FIG. 28 is a partial cross section along V.V. of FIG. 27.

Figure 29:
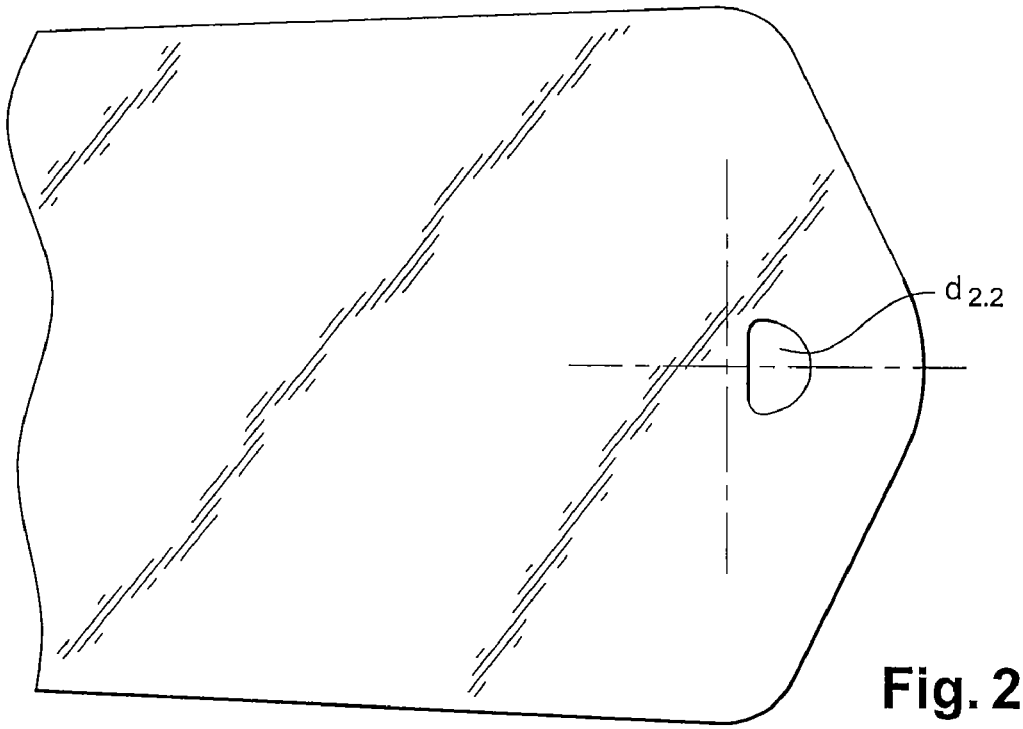

FIG. 29 is a view of the lower outer face of the tooth.

Figure 30:
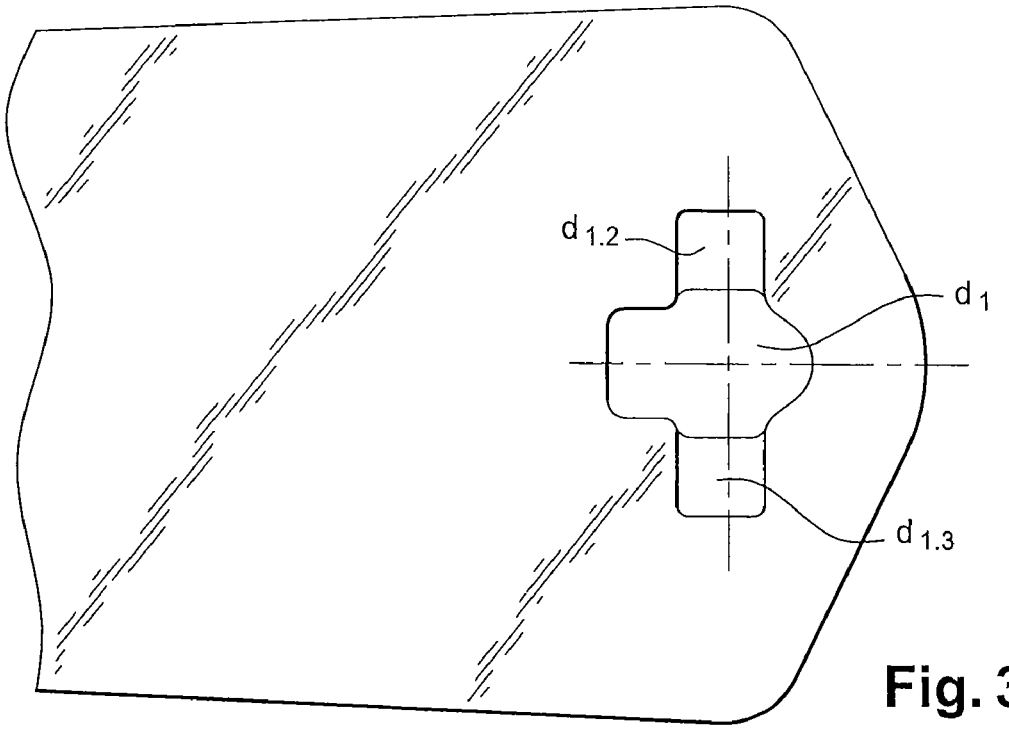

FIG. 30 is a view of the upper outer face of the tooth.

Figure 31:
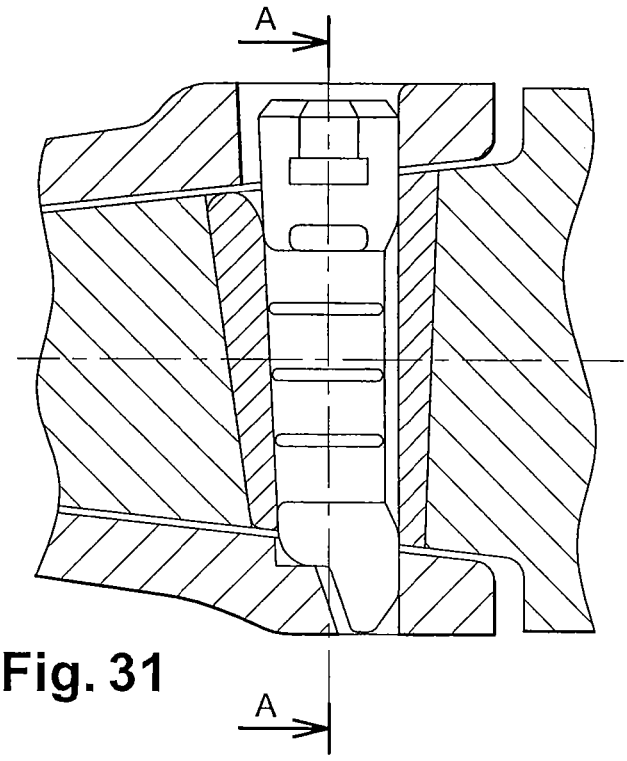

FIG. 31 is a partial cross section illustrating the assembly key-sleeve keying device between the tooth and the adapter.

Figure 32:
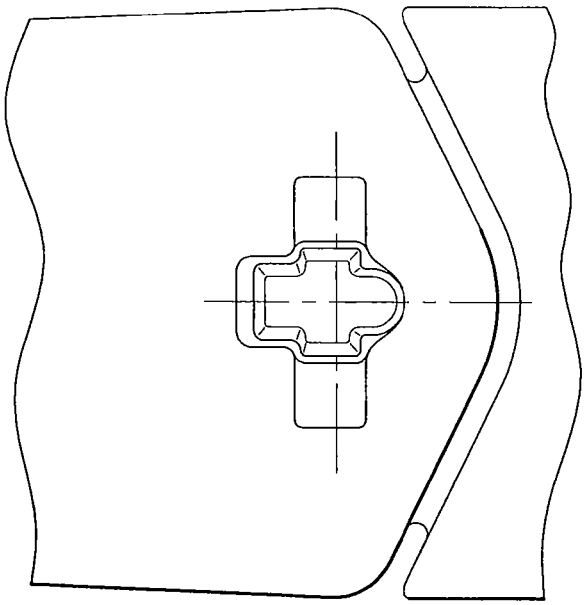

FIG. 32 is a plan view according to FIG. 31.

Figure 33:
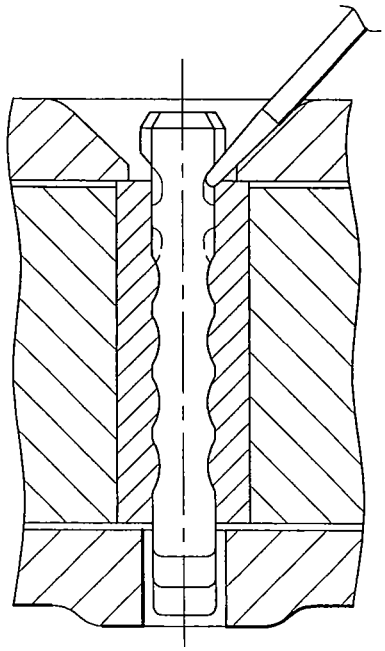

FIG. 33 is a cross section according to FIG. 31, illustrating the removal of the key.

DETAILED DESCRIPTION

To make the object of the invention more concrete, it is now described in a non-limiting manner illustrated in the figures of the drawings.

The assembly for coupling wear parts on tool holders for civil engineering machines, to meet the objectives of the invention, uses a tooth (D) and an adapter (A) which can be combined and joined by a key (C).

To meet the first objective of absorbing the loads inherent in the applications, the nose of the adapter is arranged in a known manner in the front with a stabilisation flat and optional openings for receiving side lugs at the ends of the tooth. According to the invention, the tooth and the adapter are arranged with bearing profiled matching shapes (FA) in different planes located between their respective ends and the stabilisation flat for the adapter and the tooth bottom, on the one hand, and their opposite connecting and centering ends on the other. These matching shapes (FA) are arranged symmetrically and opposably on the upper (FS) and lower (FI) faces of the nose of the adapter and of the tooth. These matching shapes are therefore additional bearing zones which supplement the bearing zones installed on the stabilisation flats, in front of the adapter nose, and at the back, if applicable, in the tooth lug housings, which are no longer exclusively required to absorb all the loads during the application of a stress on the stabilisation flat. These matching bearing profiled shapes (FA) serve to increase the area of the stabilisation flats, to ensure a better distribution of the loads received by the adapter nose, and to increase the total area receiving the loads transmitted. This serves to reduce the possibility of movement of the tooth with respect to the adapter and to reduce wear.

With reference to FIGS. 10 to 18, the upper (FS) and lower (FI) faces of the adapter nose are arranged between the front part of the stabilisation flat and the back part beyond the zone constituting the adapter nose with staged shapes established on all or part of the nose width. Thus, the said staged shapes present on the upper and lower faces of the adapter nose are established in the prolongation of the stabilisation flat, established along a plane (a) which is prolonged by an inclined plane (a2) up to the connection with the upper part connecting the zone of the adapter nose to the adapter body. The staged shape thereby defines a matching upper bearing plane (a3) which is angularly oriented with respect to the plane (a) of the stabilisation flat and also with respect to the oblique connecting plane (a2). The staged shape, in its front part, is in turn connected to the stabilisation flat (a1), itself offset from the plane (a), by a recessed inclined plane (a4), so that the said shape, in its front part, has a sloping configuration forming a notch. The plane (a2) is inclined along the angle (G2) to the plane (a). The plane (a3), which starts at the same apex (0) as the plane (a2), defines, with the latter, an angulation (G3) lower than the angulation (G2), thereby permitting the establishment of the contact planes (a4-a5) forming stops along an inclination (G4) lower than 90° to the plane (a1) and oriented with respect to the longitudinal axis of the assembly along an inclination (G5) also lower than 90° to increase the angular locking capacity of the planes (a4) and (a5). The shape (FA) thus described is present on the lower face of the adapter nose symmetrically and opposedly to the longitudinal median axis of the adapter. The width of the shape (FA) on the adapter nose is preferably equal to half of the total width of the adapter nose, thereby leaving the inclined plane (a2) partially free. It should be noted that the zone of connection of the upper inclined plane (a3) to the inclined plane (a2) may be situated at any level with regard to the adapter body. The staged clearance of the planes (a) and (a1) (FIG. 10) serves to increase the area of the planes (a4 and a5) and forms a catch which favours the lateral locking of the tooth effectively because located on the most advanced zone of the adapter support.

The planes (a6) and (a7) are defined by the junction of the upper (a3) and connecting (a2) planes and are advantageously vertical. They perform the role of catches with, in addition, a horizontal alignment self-centering of the tooth on the adapter support.

The particular configuration of the adapter nose, by its additional bearing shapes, offers a better interlocking of the tooth on the adapter nose.

Figure 1:
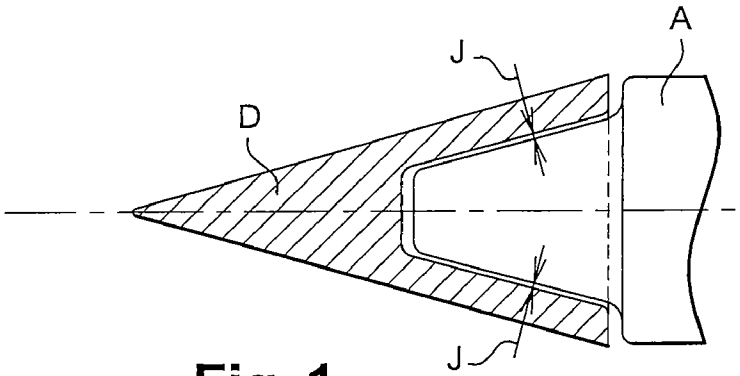
FIGS. 1 and 2 are schematic views illustrating the tooth-adapter coupling in a conical nesting configuration of the prior art.
Figure 2:
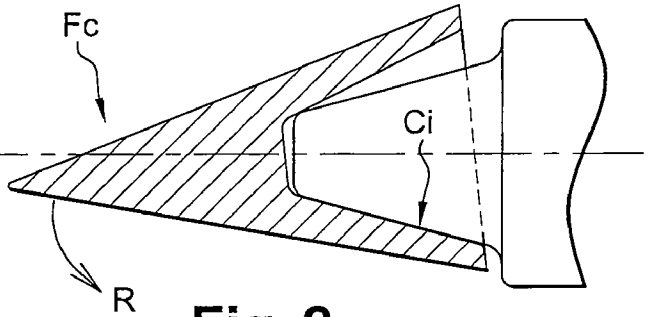
Figure 3:
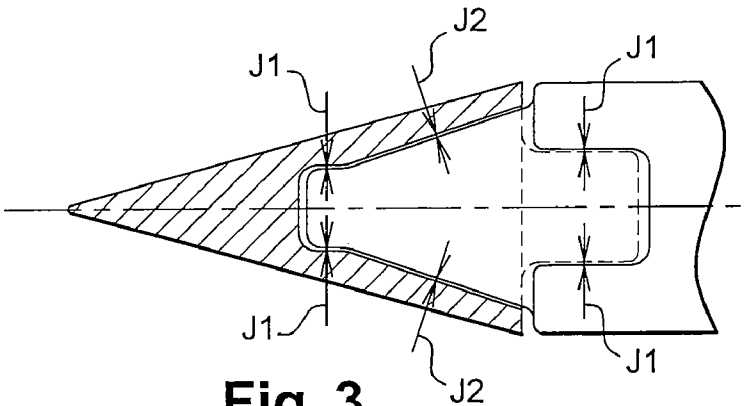
FIGS. 3 and 4 are alternative schematic views in which the nose-adapter has a front stabilisation flat and in which the connection of the tooth to the adapter is obtained and supplemented by lugs.
Figure 4:
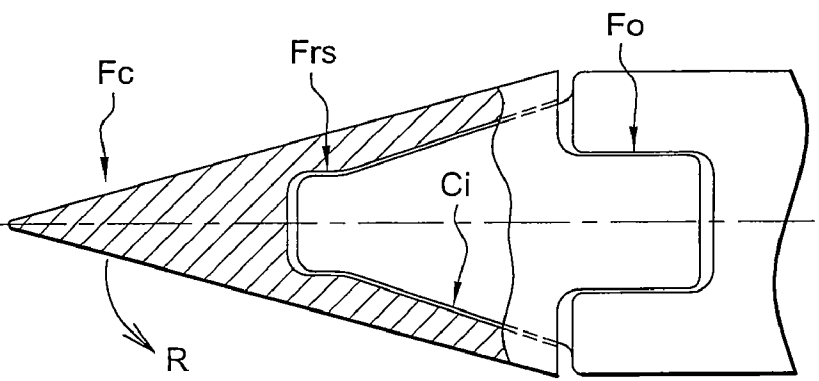
Figure 7:
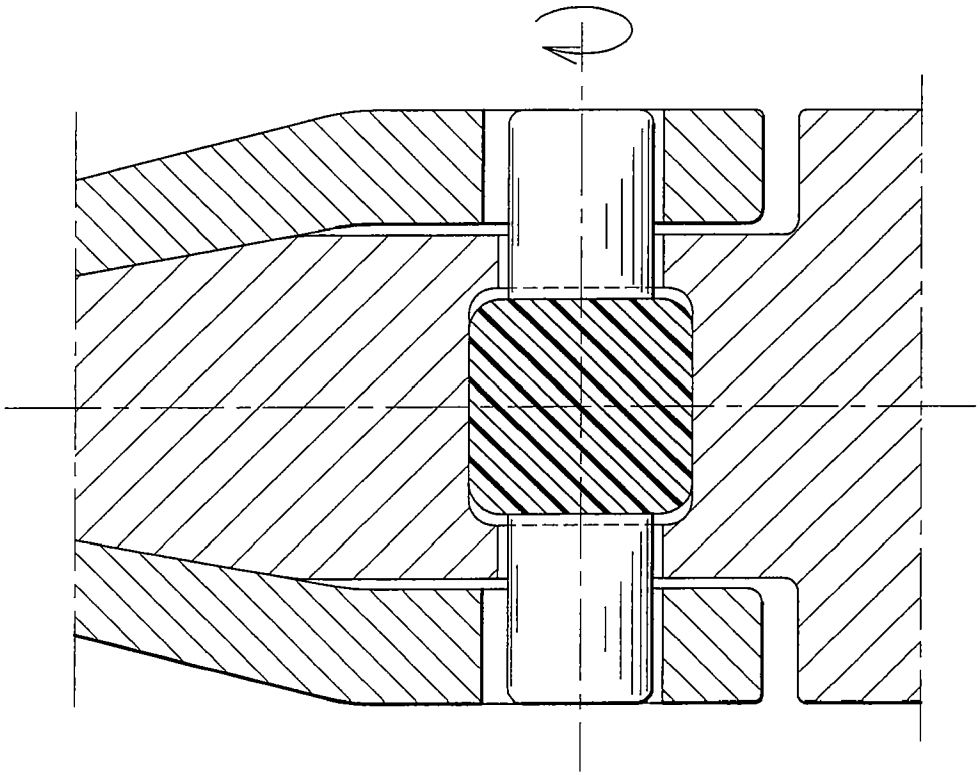
FIG. 7 is a view showing the mounting of the key in a tooth-adapter assembly of the prior art.
Figure 6:
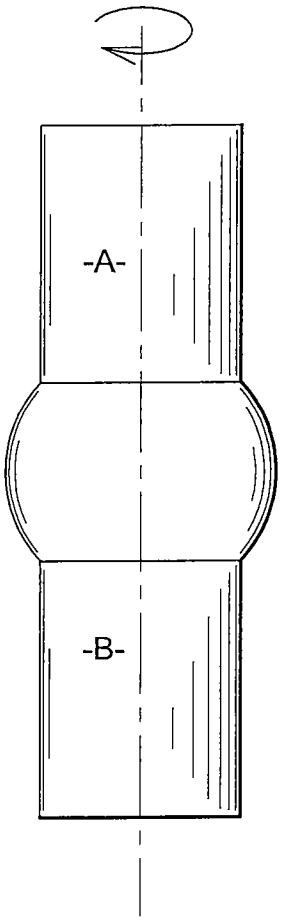
FIG. 6 is a view of the key, according to FIG. 5.
Figure 5:
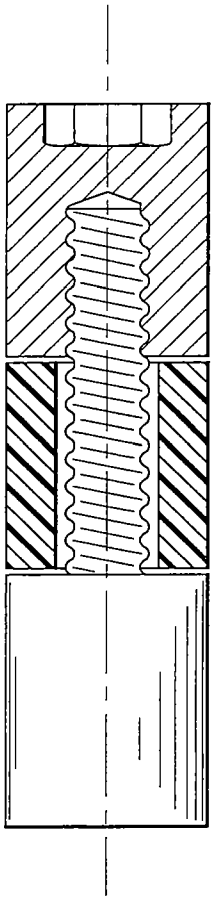
FIG. 5 is a view of a screwed key of the prior art, in a half section.
Figure 9:
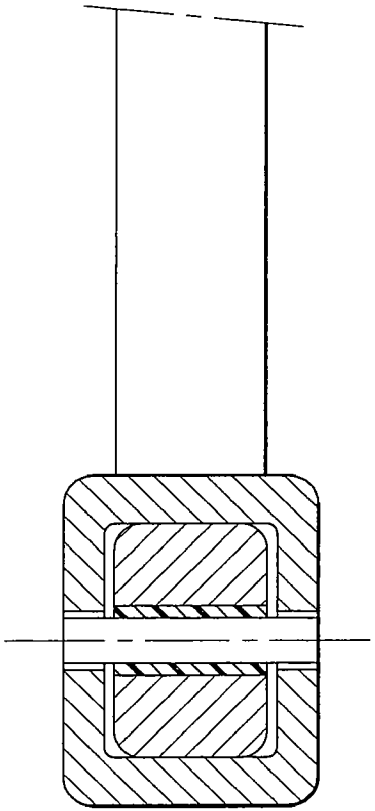
FIG. 9 is a cross section along A.A. of FIG. 8.
Figure 8:
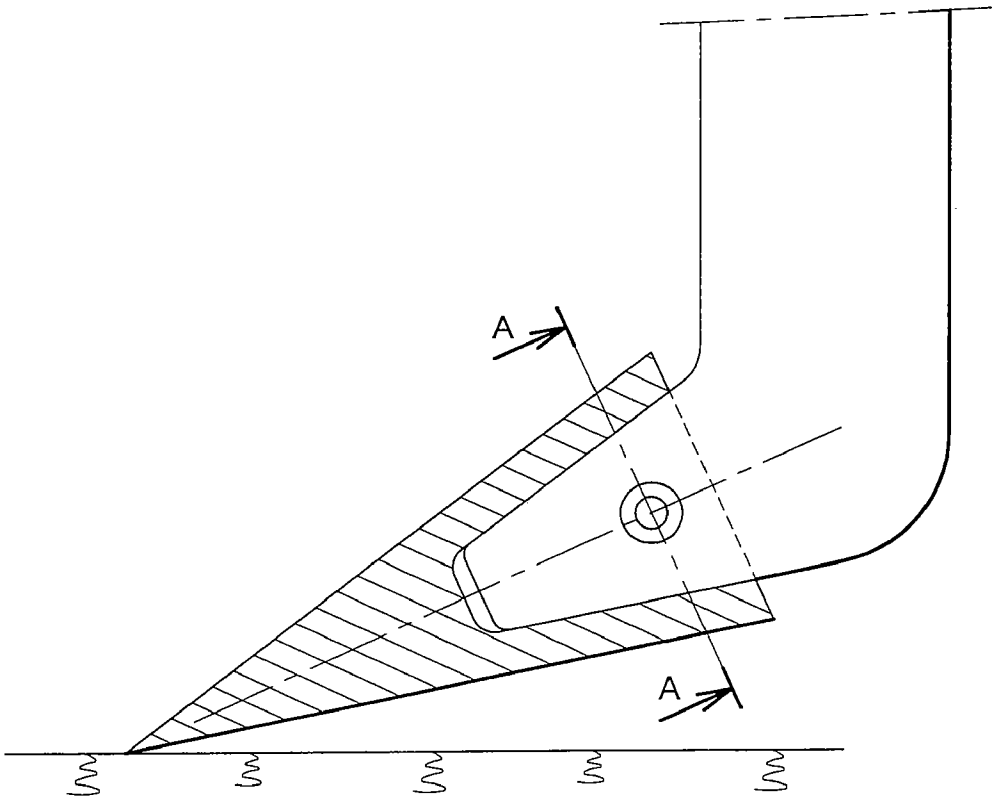
FIG. 8 is a view of a so-called RIPPER tooth of the prior art, with the use of a key integrating a sleeve.
Figure 10:
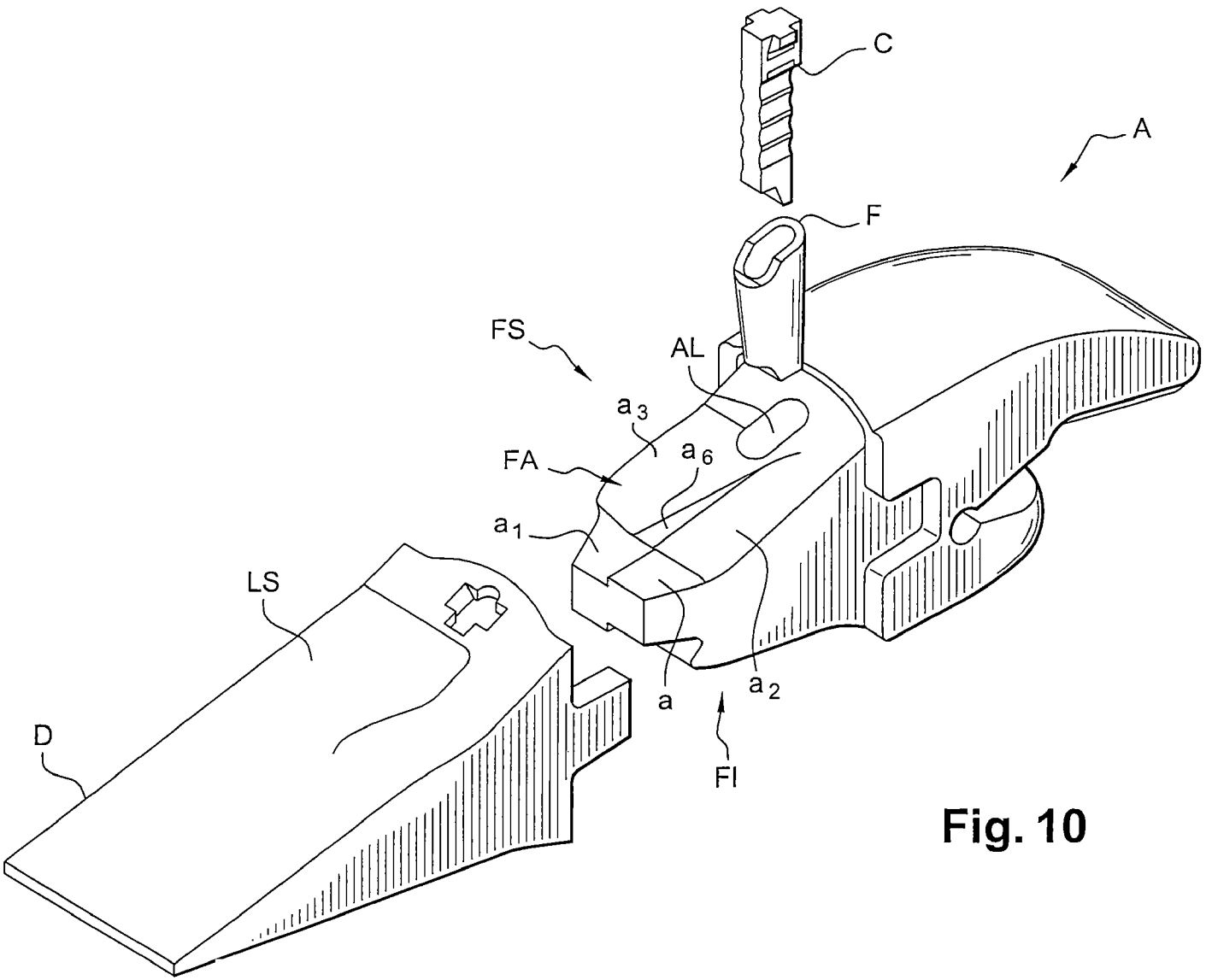
FIG. 10 is a prospective view of the tooth-adapter sleeve-key coupling assembly, before erection, showing one embodiment of the matching contact and connecting shapes established on the adapter and the tooth.
Figure 11:
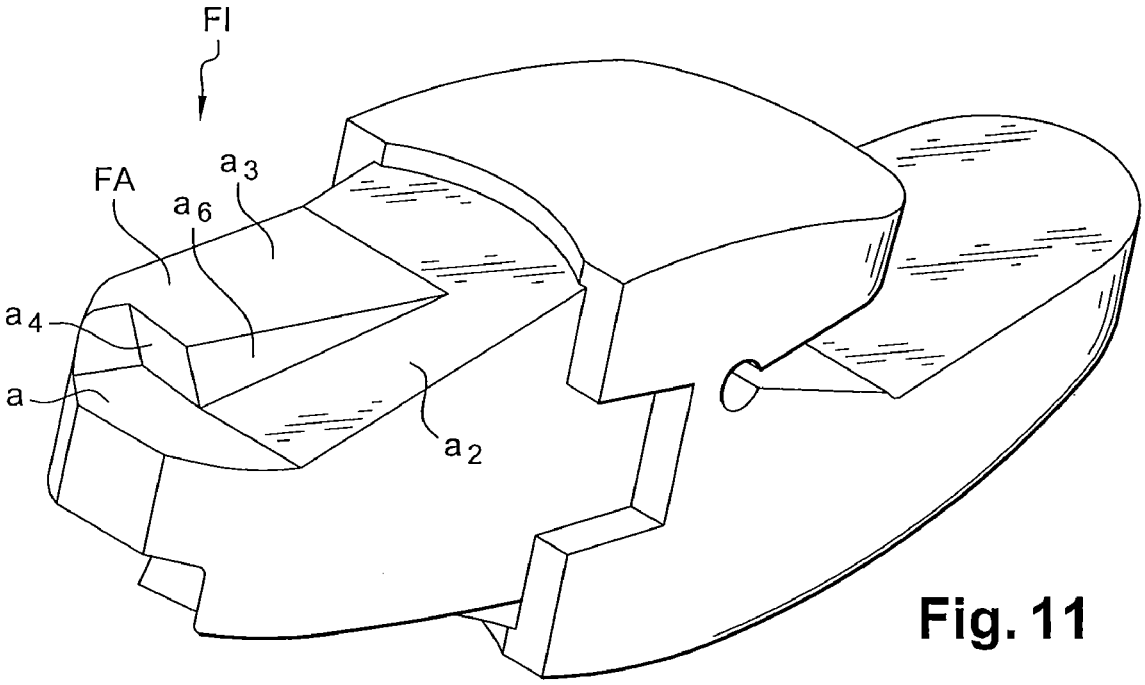
FIG. 11 is a bottom view of the adapter as shown in FIG. 10.
Figure 14:
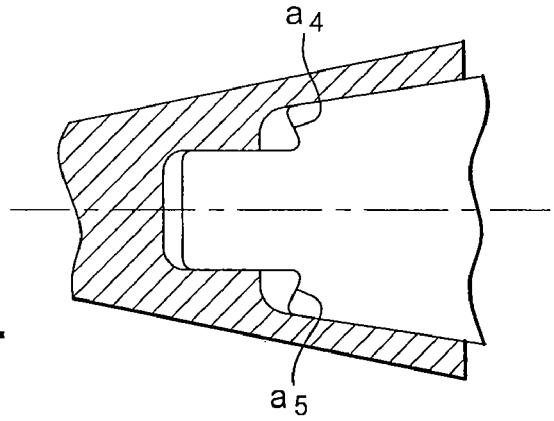
FIG. 14 is a schematic view of another internal configuration of the tooth.
Figure 12:
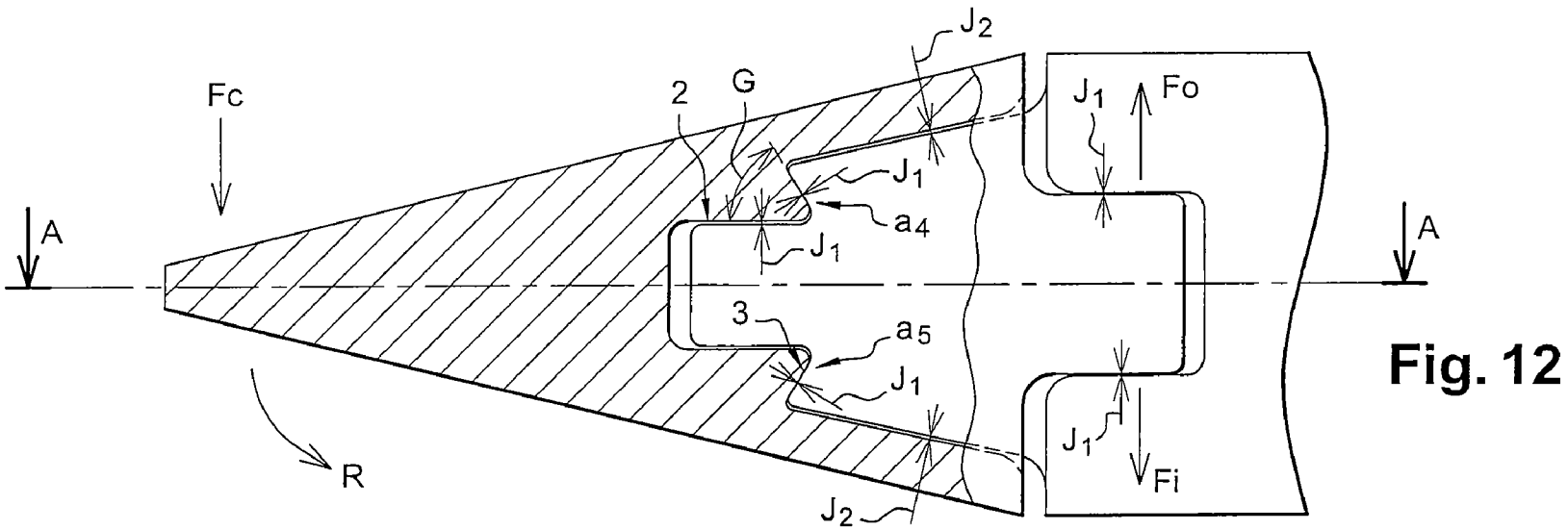
FIG. 12 is a longitudinal cross section along XIII.XIII of the tooth-adapter coupling assembly after erection in a first alternative internal arrangement of the tooth.
Figure 13:
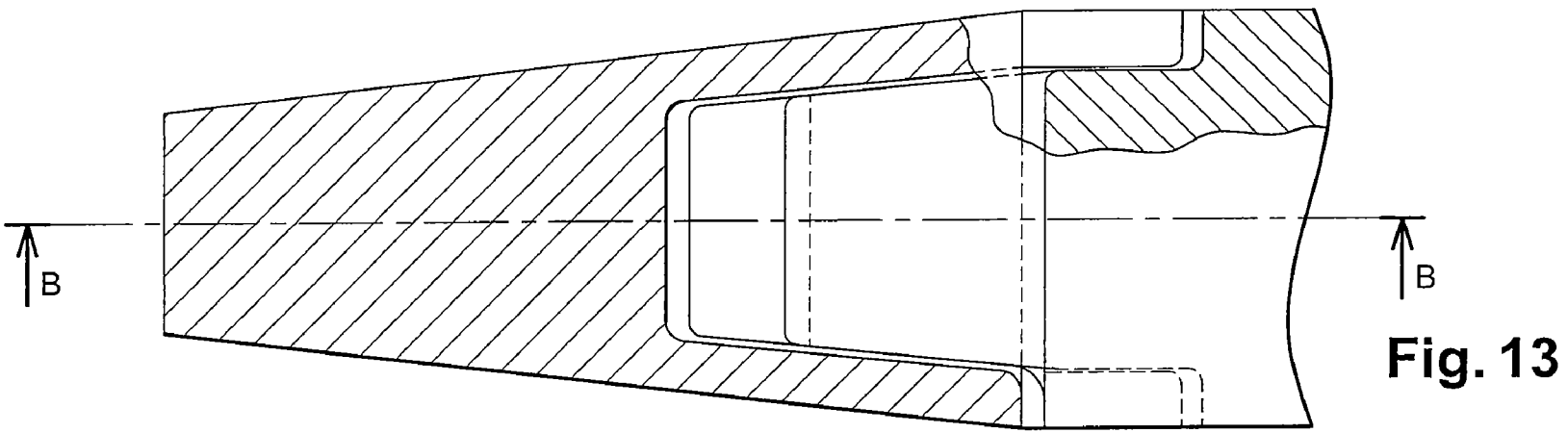
FIG. 13 is a plan view and cross section along XII.XII.
Figure 15:
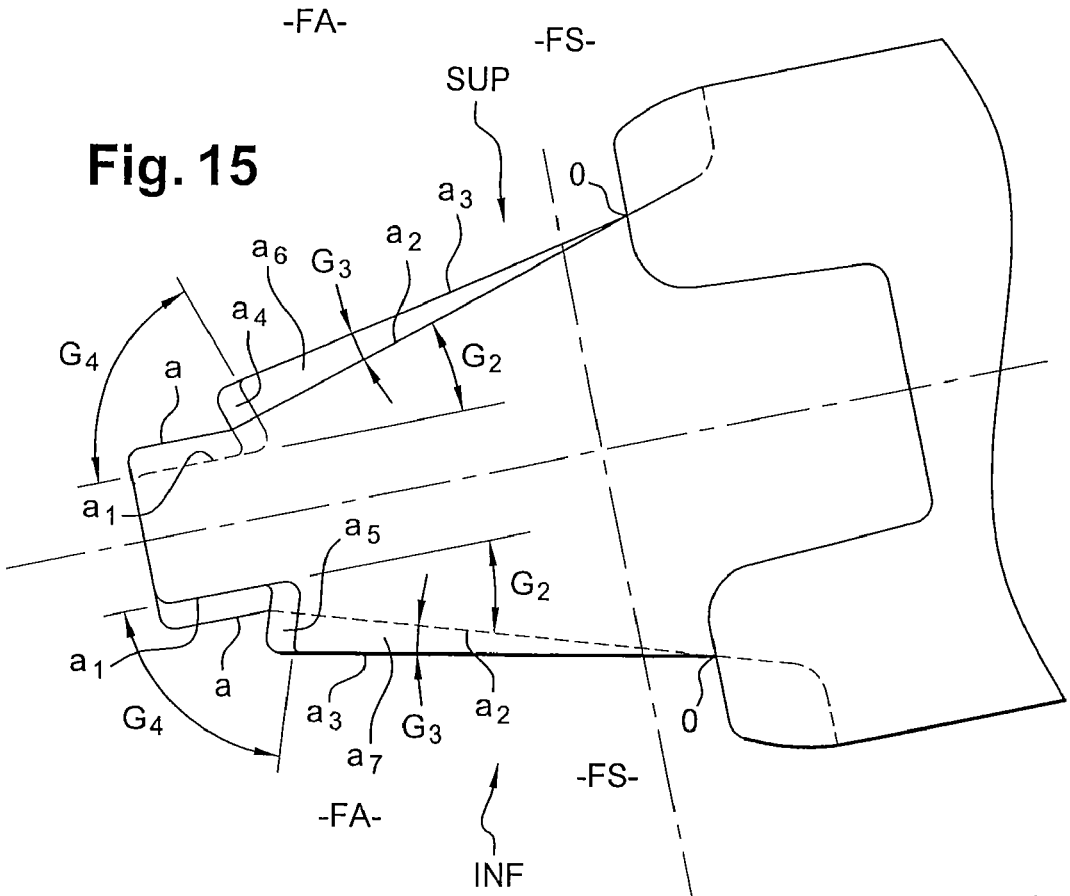
FIG. 15 is a partial side view of the end of the adapter nose.
Figure 16:
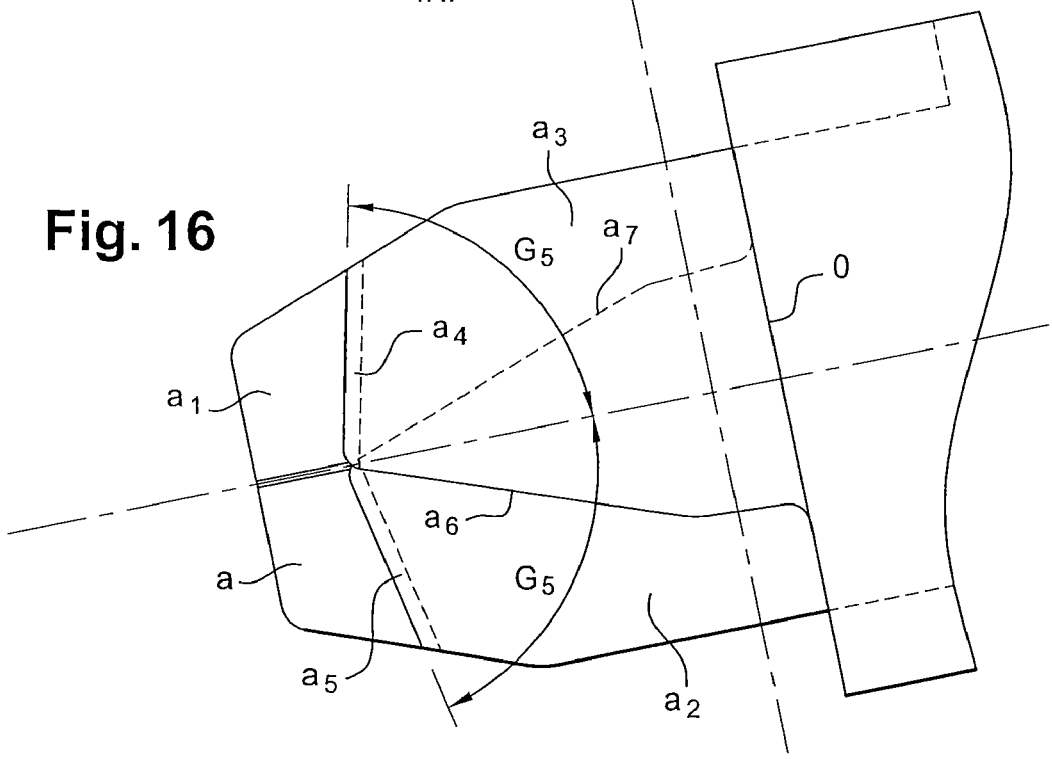
FIG. 16 is a plan view according to FIG. 15.
Figure 17:
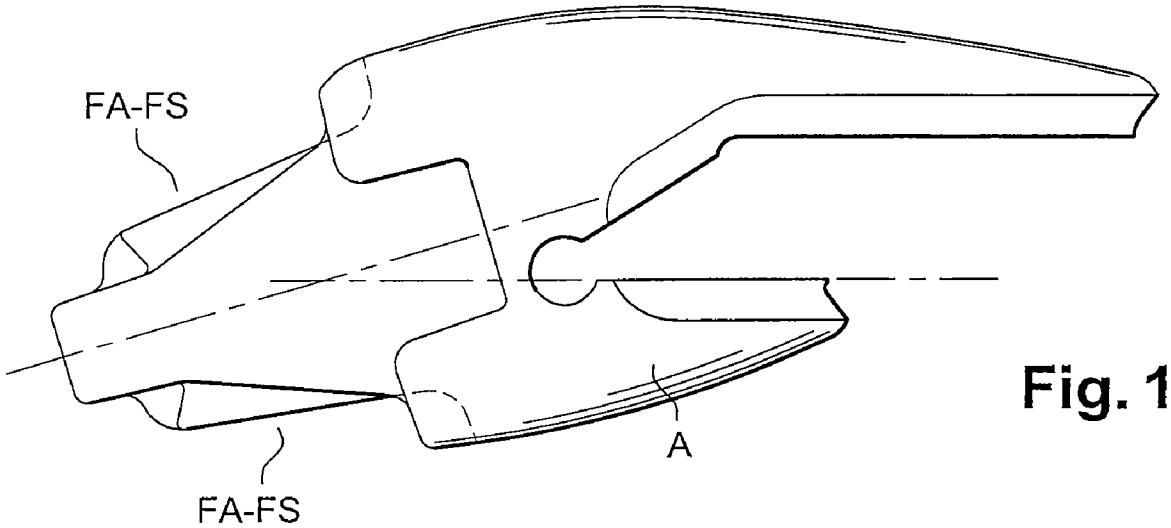
FIG. 17 is an alternative view according to FIG. 15.
Figure 18:
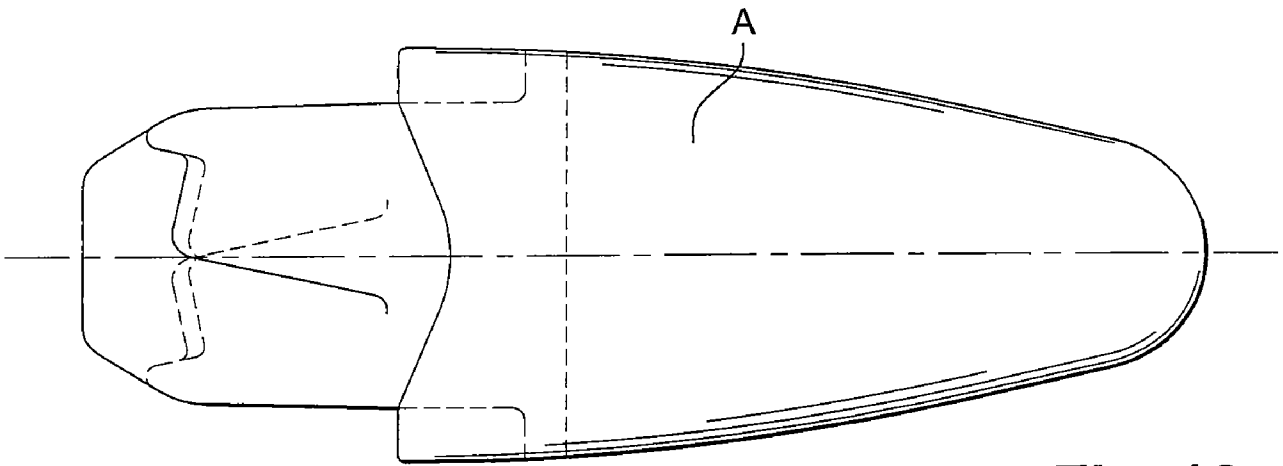
FIG. 18 is a plan view according to FIG. 17.

The tooth is thereby arranged matchingly for receiving the additional shapes of the adapter nose. FIG. 10 thus illustrates the upper (LS) and lower (LI) housings positioned from the upper and lower faces of the teeth, and receiving the shape (FA) of the abovementioned type. These housings thus have bearing and contact walls with the shapes (FA). Moreover, and as shown in FIGS. 12 and 14, the junction zone with the front end forming a notch of the shape (FA), may be matching (FIG. 12) to define a firm nesting of the opposite matching parts, or as an alternative, the tooth may (FIG. 14) have an internal clearance, so that the notch part is not connected to and in contact with the bottom of the housing established on the tooth and receiving the matching shapes (FA).

This makes it clear that the particular configuration of the nose of the adapter and of the tooth very substantially increases the contact and bearing areas. Without going beyond the scope of the invention, the intermediate bearing zones may be placed on the horizontal and/or vertical faces of the adapter nose, the tooth being arranged matchingly.

This implementation thereby meets a first objective, to limit the respective movements of the tooth on the adapter with an increase in the bearing areas and their angular orientation in order to be favourably positioned to deal with and absorb the multidirectional loads transmitted by the tooth.

In accordance with the applications and uses of the coupling assemblies, this implementation may be sufficient, and irrespective of the keying system employed.

However, in the context of optimisation of the securing of the tooth on the adapter, and in order to further limit the wear of the parts caused by the loads applied, the implementation of a keyed connecting device can provide further guarantees for the longevity of the coupling assembly.

The keyed connecting device solving the second problem posed and initially discussed is now described.

The keying device of the invention, in order to perform the functions and meet the objectives described above, comprises a key C, having a specific profile and conformation, capable of engaging in and cooperating with a sleeve (F) having an elastic deformation capacity. The key and the sleeve are capable of being engaged and protected in the assembly of the tooth (D) to the adapter (A) located on the skips and buckets of civil engineering machines. The adapter and the tooth are themselves profiled, one to internally receive the said sleeve, and the other, on the one hand, to protect the key partly projecting from the top of the sleeve and to permit the introduction of key dismantling tools in a situation of removal of the worn tooth. Thus the four main elements, tooth, adapter, key and sleeve, have interactive profiles to ensure the assembly, securing and dismantling. Thus the adapter (A) has a housing (AL) for receiving the elastic sleeve (F) (FIG. 25) and the tooth (D) (FIGS. 26, 27, 28 and 29) has an upper orifice (D1) for introducing the key (C) with the passages (D1,2) and (D1,3) for the access of the key dismantling tool, and a lower orifice (D2) comprising the stop (D2, 1) and a projecting part (D2,2).

It is now important to describe the specificity of each of these elements, and to describe the key assembly and disassembly procedures.

Following is the description of the key of the invention, which has three specific zones (Z1, Z2, Z3), one lower (Z1) fitting into the lower part of the tooth, a second intermediate (Z2) for engaging and cooperating with the sleeve, and the other upper zone (Z3) projecting from the sleeve and situated in the upper part of the tooth and permitting the access and gripping of a removal tool.

The key consists of a pyramidal body (C1) itself permitting a wedge action to be obtained, whereof the cross section is rectangular or trapezoidal. The back face in contact with the orifices of the tooth (D) is more advantageously rounded.

In its upper part (Z3), on each of its two side faces, are a boss (C2-C3) performing a tool gripping and counter-support function, and one or more successive horizontals notches (C4) spaced along the said parts. These notches are designed to permit the positioning of the tip of the removal tool. At least the upper slot which appears in FIG. 19 is disengaged from the sleeve (F) and in the space or introductory opening formed in the tooth. The following notch(es) may be partially situated in the internal volume of the sleeve when the key is in place. The disengagement of the key allows the progress of access to the other notches to again permit the positioning of the tool and to perform an additional disengagement until the final removal of the key.

The intermediate part (Z2) of the key accordingly has, on its two side faces whereof the area is deliberately widely dimensioned and underlying, one or more hollow zones (C5) separated by relief zones (C15) alternately. The said zones (C5-C15) are established in a horizontal plane on the said side faces. These said zones (C5-C15) thus have a matching profile with a similar configuration to that in the internal part of the sleeve (F) with a matching succession of hollow and relief zones (F15-F16) to permit an assembly and locking in position of the key in the sleeve. With regard to the composition of the sleeve of a material having an elastic deformation capacity, a firm connection of the key in the sleeve is obtained.

The front face (C6) of the key is straight and terminates in a lower zone with a radius or bevel (C7) to avoid a corner which could damage the zone (F1-2) of the elastic sleeve during its introduction.

The back face of the key comprises a zone (C8) set back from the two active faces (C9) and (C 10), placed in the upper and lower part of the key, which bear in the two orifices (D1) and (D2) of the tooth (D). The active face (C9) is arranged with a catch (C11) forming a stop to block the upward exit of the key and, at the end of the active face (C10), a bevel (C12) to facilitate the positioning of the bottom end of the key in the orifice of the tooth (D2).

The lower zone (Z1) of the key projecting from the sleeve has a stop face (C13) and the small section end (C 14).

The key thus defined is very long and is capable of projecting from the sleeve (F) in which it is engaged, on the one hand by its upper part, and on the other, by its lower part as shown in FIGS. 31 and 33 of the drawings.

Without going beyond the scope of the invention, the said notches (C4) may have transverse undercuts in their thickness to facilitate tool gripping.

It is now necessary to describe the configuration of the sleeve (F). This is made from a material having an elastic deformation capacity. For example, it is made from rubber or polyurethane resin. This sleeve has a pyramidal external shape in order to facilitate its positioning and replacement in its housing (AL) formed in the adapter support. This sleeve comprises a through central opening (F1) receiving the key (C). On its front lower face (F1-1), a material reinforcement (F1-2) is placed, representing the elastic volume that is compressed by the key during its introduction. The upper (F2) and lower (F3) shapes of the front face are established so that they leave a void in the housing (AL) of the adapter support to permit the expansion of the material reinforcement (F1-2) during its compression by the key.

On the side internal faces of the passage (F1) are placed a variable number of reliefs (F1-3) corresponding to those established on the side faces of the key and whereof the shape is conjugated with those of the corresponding hollows (C5) of the key.

The back internal face is referenced (F1-4) and is straight. It has the function of guiding the key during its introduction. The height of the sleeve is determined to correspond to the intermediate zone (Z2) of the key with its successive hollow and relief parts (C5-C15).

To facilitate the sliding of the key (C) on the material reinforcement (F1-2), a metal plate may be incorporated on its surface.

Thus according to the invention, the key joined to the tooth by its contacts in the orifices thereof also has, on its side faces (C15) and (C16), a tight elastic bearing on the side faces (F1.5) and (F1.6) of the sleeve (F).

The key and the sleeve, as described according to the invention, requires specific arrangements of the tooth and the adapter. Reference may accordingly be made to FIGS. 26 to 30.

Concerning the adapter, it has a vertical opening with a pyramidal configuration for receiving the sleeve. The tooth has an upper orifice (D1) for the introduction of the key with flared parts (D12-D13) to allow the passage of the active part of the dismantling tool and access to the different notches (C4). Moreover, the said flared parts have a straight sloping profile (D12.1-D13.1) to constitute a counter-support base during the pivoting of the disengagement tool. The lower part of the tooth (D) has a passage opening (D2) for the lower end of the key with an upper unhooking zone (D2.1) corresponding to the bearing zone of the zone (C13) of the key forming a seat, the lower projecting part being referenced by (D2.2) and receiving the final end of the key.

It is now necessary to describe the implementation of the invention and its operation.

The key is assembled with the sleeve as follows. The sleeve (F) is first introduced into its housing (AL) of the adapter support (A) (see FIG. 26) and is held by the corresponding pyramidal shape. The tooth (D) is positioned, that is introduced on the adapter, and the key is then forcefully introduced, using a striking tool. By its particular arrangements, the key cannot be placed upside down. The wedge shape of the key serves to facilitate its introduction by progressively compressing the zone (F1-2) of the sleeve (F). The force required for introduction is also therefore progressively and only reaches its maximum in the final position. This is obtained when the stop face (C13) meets the face (D2-1) of the tooth. This stop face (D2-1) is set far back so as to always exist, even in case of extreme wear of the outer face of the tooth. The bevel (C12) has permitted the entrance of the key into the orifice (D2) of the tooth even if there is forward shift in the position of the tooth with regard to its adapter support. The key, by the succession of its projecting and hollow zones, is therefore centred and held in the matching hollow and projecting zones of the sleeve. The material selected for the sleeve, due to its elastic deformation capacity, allows it to be retracted or crushed during the forcible passage of the relief zones of the key with regard to the relief zones of the sleeve. After passage, the side relief zones of the sleeve resume their initial position and are anchored in the hollow zones of the key. After positioning, the assembly situation shown in FIGS. 31 and 32 is obtained.

In a use situation during service, the following facts may be observed. The compression of the material reinforcement (F1-2) of the sleeve by the key creates a reactive force thrusting the latter backwards and whereof the active faces (C9) and (C10) of the key bear on the back of the orifices (D1) and (D2) of the tooth which is thus firmly held on this support. This compressing of the said reinforcement (F1-2) causes the deformation of the elastic sleeve which, being crushed, can still elongate, and occupies the voids left in the housing (AL) of the adapter support close to the zones (F2) and (F3). This compression also creates, due to the key C thrust backward, a bearing force on the back internal face (F1-4) of the sleeve. To avoid an opposing reaction from the face (F1-4) which could tend to repel the key frontward and commensurately reduce the retaining force of the tooth, the key has a clearance (C8) which eliminates its contact with the face (F1-4) which can no longer transmit an opposing reaction.

Irrespective of the vertical downward pressure of the earthworks and other materials on the key, the maintenance of the keying during service is guaranteed by the impossibility of exiting downwards due to the locking of the key against the stop face (D2-1) of the tooth. To contend with the risk of the upward pressure of the materials, the securing of the key, with respect to a possible upward exit, is guaranteed in several ways.

a) The lower projecting orifice (D2-2) of the tooth has a deliberately small area (see FIG. 29), leaving very little access to materials which may bear on the tip of the key, which also has a very small cross section, and hence can only receive a low thrust.

b) The two-sided gripping, formed by the locking of the hollow zones (C5) of the key by the reliefs (F1-3) of the sleeve, is established over a very large area. Moreover, the compressing of the material reinforcement (F1-2) affects all the material located in the zones close to it. This is the case of the reliefs (F1-3) which stiffen considerably and create a very firm locking in the hollows (C5) of the key.

Advantageously, this configuration of the reliefs (F1-3) of the sleeve and of the hollows (C5), and of the key, has the particular feature of being established parallel to the horizontal access of the assembly in order to allow complete freedom to the key to advance or retreat from its position according to the level of penetration of the tooth on its adapter support. The staged reliefs (F1-3) form a stepwise retention preventing any total direct accidental exit. This can only occur by corresponding steps at each level (F1-3).

If, despite these arrangements, a key happened to tend to rise, in the full view of the machine operator, he could easily push it back into position without any risk of losing a tooth.

c) In extreme cases, the option remains of having, at the back of the key, an upper zone of the catch (C11) that would form one more stop to oppose any rising of the key.

The key dismantling procedures will now be described.

This takes place from the top, hence in a readily accessible position, using a conventional tool forming a lever such as a screwdriver which, pressed on the faces (D1-2-1) and (D1-3-1) of the passages (D1-2) and (D1-3), can lift the key by insertion in the notches (C4) under the two bosses (C2) and (C3) and in the following notches (C4), using a counter-support action on the straight parts with a tilting of the tool which causes the key to rise. The force applied on the tool is sufficient to disengage the solid and hollowed matching parts formed on the sleeve and the key.

The height of the bosses (C2) and (C3) is deliberately large so that, in case of extreme wear of the upper face of the tooth, enough material remains on the key for the lever action as shown above.

The solution provided by the invention by a firm connection between the key and the sleeve due to the matching of the projecting hollow shapes on the side faces (C15-C16) and the side faces (F15-F16) of the sleeve, with a tight elastic connection, helps to solve the problem of controlling the pivoting of the tooth with regard to the adapter nose. The key-sleeve assembly forms a one-piece assembly which stiffens the tooth-adapter connection, and limits the possibility of pivoting. This is an important advantage of the invention.

If, in an exceptional case of force majeure, the dismantling process could not be completed, the possibility remains of extracting the key by upward action via the projecting lower orifice of the tooth (D2-2). In the case in which the key has a catch forming a stop (C11), the dismantling tool would no longer have a simple vertical movement to be made, but should, at the start, also perform a frontward lever action to disengage the stop (C11).

The advantages of this key connection device clearly emerge from the invention and it is particularly important to observe the easy assembly and disassembly of the key while meeting the strength and safety requirements during use of the overall device. The key and its sleeve are also perfectly protected in the tooth-adapter coupling.

On the whole, a coupling assembly which combines the implementation of the two basic features, that is the integration of the matching bearing zones on the nose of the adapter, and also the keying device, offers a guarantee of use substantially greater than the prior art, with a limitation of wear of the tooth and the adapter despite the variety of multidirectional loads.

The invention claimed is:

1. Assembly for coupling wear parts on tool holders for civil engineering machines comprising a tooth and an adapter with a keyed connection having bearing profiled matching shapes in different planes, located between respective contact and connecting ends, the matching shapes are arranged symmetrically and opposably on upper and lower faces of a nose of the adapter and of the tooth, and the bearing profiled matching shapes comprise staged shapes in different staged planes located between respective ends defined by a stabilization flat for the adapter nose and a root, for the tooth, and opposite connecting and centering ends, and said staged shapes present on the upper and lower faces of the adapter nose are established in prolongation of the stabilization flat and include an inclined plane extending from a plane of a first portion of the stabilization flat up to a connection with an upper part connecting the adapter nose to an adapter body, and a matching upper bearing plane which is angularly oriented with respect to the plane of the first portion of the stabilization flat and with respect to the inclined plane.

2. Coupling assembly according to claim 1, wherein a front part of the matching upper bearing plane is connected to a second portion of the stabilization flat and said second portion is offset from the plane of the first portion.

3. Coupling assembly according to claim 2, wherein the front part, is connected to the second portion of the stabilization flat by a recessed inclined plane forming a notch.

4. Coupling assembly according to claim 1, wherein the inclined plane is inclined at a first angle to the plane of the first portion, and the matching bearing upper plane begins at a same apex as the inclined plane and defines an angle relative to the inclined plane smaller than the first angle, and further comprising contact planes forming stop at an inclination lower then 90°.

5. Coupling assembly according to claim 1, further comprising a junction planes defined by a junction of the matching bearing upper plane and the inclined plane serving as a catch and providing a horizontal alignment self-centering of the tooth on a support of the adapter.

6. Coupling assembly according to claim 3, wherein the tooth is matchingly arranged for receiving the staged shapes of the adapter nose, with upper and lower housings positioned from the upper and lower faces of the tooth, for receiving and constituting bearing and contact walls with the staged shapes of the adapter nose.

7. Coupling assembly according to claim 6, wherein a junction zone of the housings has a front end forming a shaped slot for firm nesting of the adapter nose.

8. Coupling assembly according to claim 7, wherein the shaped slot, has an internal clearance, so that the notch is not connected to and in contact with an end of the housings.

* * * * *

UNITED STATES PATENT AND TRADEMARK OFFICE

CERTIFICATE OF CORRECTION

PATENT NO. : 7,523,572 B2
APPLICATION NO. : 11/720344
DATED : April 28, 2009
INVENTOR(S) : Pasqualini It is certified that error appears in the above-identified patent and that said Letters Patent is hereby corrected as shown below:

Claim 4, Col. 12, Line 9: Delete "forming stop at an inclination" and insert -- forming stops at an inclination --

Claim 4, Col. 12, Line 10: Delete "lower then 90°" and insert -- lower than 90° --

Claim 5, Col. 12, Line 12: Delete "junction planes defined" and insert -- junction plane defined --

Signed and Sealed this

Eleventh Day of August, 2009

David J. Kappos

David J. Kappos
*Director of the United States Patent and Trademark Office*